US008596370B2

(12) United States Patent
Rex et al.

(10) Patent No.: US 8,596,370 B2
(45) Date of Patent: Dec. 3, 2013

(54) ANNULAR SEAL FOR EXPANDED PIPE WITH ONE WAY FLOW FEATURE

(75) Inventors: Ines Rex, Lehrte-Arpke (DE); Keven O'Connor, Houston, TX (US); Joerg Lehr, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/227,040

(22) Filed: Sep. 7, 2011

(65) Prior Publication Data

US 2013/0056228 A1 Mar. 7, 2013

(51) Int. Cl.
*E21B 33/126* (2006.01)

(52) U.S. Cl.
USPC ..... 166/387; 166/384; 166/208; 166/202; 166/346

(58) Field of Classification Search
USPC ..... 166/387, 208, 202, 346, 382
See application file for complete search history.

(56) References Cited

U.S. PATENT DOCUMENTS 4,243,397 A * 1/1981 Tokar et al. ..... 55/487
4,482,013 A * 11/1984 Fulkerson ..... 166/118
6,959,759 B2 11/2005 Doane et al.
7,051,805 B2 5/2006 Doane et al.
7,134,504 B2 11/2006 Doane et al.
7,640,984 B2 1/2010 Vert et al.
7,703,542 B2 4/2010 O'Connor et al.
7,845,402 B2 12/2010 O'Connor et al.
7,886,818 B1 2/2011 O'Connor et al.
2002/0066576 A1 6/2002 Cook et al.
2008/0223572 A1* 9/2008 Vert et al. ..... 166/156
2008/0251250 A1 10/2008 Brezinski et al.
2009/0194947 A1* 8/2009 Templeton et al. ..... 277/335
2010/0032168 A1* 2/2010 Adam et al. ..... 166/382
2010/0212891 A1* 8/2010 Stewart et al. ..... 166/250.12

* cited by examiner

*Primary Examiner* — David Bagnell
*Assistant Examiner* — Taras P Bemko
(74) *Attorney, Agent, or Firm* — Steve Rosenblatt

(57) ABSTRACT

The seal has a base ring that expands with the underlying supporting tubular. Extending from the base ring is a pleated structure with segments folded over each other so that the run in shape is small and up against the supporting tubular for run in. The pleated segments can have internal stiffeners that also add a bias radially outwardly when the structure is freed to move in that direction. A retaining band keeps the assembly retracted until tubular expansion defeats the band to allow the unitary structure to move out radially to the wellbore or surrounding tubular. The pleated portion unfolds and spans outwardly from the base ring to retain pressure differential in one direction while allowing fluid flow in the opposite direction. The assembly can be attached to a swage device so that pressure from above can drive one or more swage members to expand a tubular.

20 Claims, 7 Drawing Sheets

ANNULAR SEAL FOR EXPANDED PIPE WITH ONE WAY FLOW FEATURE

FIELD OF THE INVENTION

The field of the invention is annular seals for tubulars that are expanded in open or cased holes and more particularly seal designs that have extended reach using released stored energy in the seal and most particularly having a one way bypass flow capability.

BACKGROUND OF THE INVENTION

Annular gaps between tubulars or a tubular string and an open hole have needed seals for a variety of reasons. In most applications the dimensions of the annular gap are fixed and resilient members can be used to span the gap. These seals can come in the form of packer cups that are made to flex to enter the surrounding tubular and are secured to a string being run in through the tubular. Another design is an annular resilient ring that is axially compressed when at the desired location. This can be done in a variety of ways such as setting down weight or applied pressure to a setting piston to name a few ways. An inflatable element can also be used.

Some of the shortcomings of such designs are that they can't accommodate expansion of the tubular to which they are mounted, they suffer from low differential pressure capacity and they have limits on how far they can extend to make a sealing contact with a surrounding tubular.

Other designs have been developed that are essentially resilient rings that expand with the tubular that supports them for an annular seal that seals in opposed directions. Some examples are U.S. Pat. Nos. 7,051,805; 6,959,759; 7,134,504; 7,703,542; 7,886,818 and 7,845,402. These seals are bidirectional and have limits on radial extension based on the tubular to which they are mounted.

Another design is revealed in US Publication 2008/0251250 where a series of overlapping petals 310 are initially retained by a band 314. The petals are connected to tubular 312 that is expanded. The band breaks with expansion of the tubular. The petals can be in a single row but are stated to be preferably in multiple rows. The main issue with this design is the dependency for sealing on petal overlap which can be problematic if the petals do not all move out radially in a uniform fashion.

The present invention describes in detail a seal that can be used in the method described by the inventors in a US application entitled Pump Down Swage Expansion Method filed on Oct. 8, 2010 and having Ser. No. 12/901,122.

The present invention addresses the issues in the prior designs and presents a seal that has a unitary structure and a capability of spanning the annular gap upon tubular expansion. It features a pleated design that has folds over adjacent folds and an optional capability of inserts to further add outward bias to the generally tapered design. A retainer holds the assembly retracted for running in and is defeated on initiation of expansion. Pressure from above the set seal can be used to advance the tubular or centralize it or to push a swage assembly that is connected to the seal. Flow past the seal in the opposite direction is possible so that fluids displaced by cementing or even cement can push past the seal. In an alternative design the cup shaped seal is mounted to the tubular to be expanded and is inserted into a surrounding tubular preferably already in contact with the surrounding tubular on insertion. The expansion of the tubular and the seal enhances the seal against the surrounding tubular by the preferably cup shaped member. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

The seal has a base ring that expands with the underlying supporting tubular. Extending from the base ring is a pleated structure with segments folded over each other so that the run in shape is small and up against the supporting tubular for run in. The pleated segments can have internal stiffeners that also add a bias radially outwardly when the structure is freed to move in that direction. A retaining band keeps the assembly retracted until tubular expansion defeats the band to allow the unitary structure to move out radially to the wellbore or surrounding tubular. The pleated portion unfolds and spans outwardly from the base ring to retain pressure differential in one direction while allowing fluid flow in the opposite direction. The assembly can be attached to a swage device so that pressure from above into the set seal can drive one or more swage members to expand a tubular.

DETAILED DESCRIPTION OF THE PREFERRED EMBODIMENT

Figure 9:
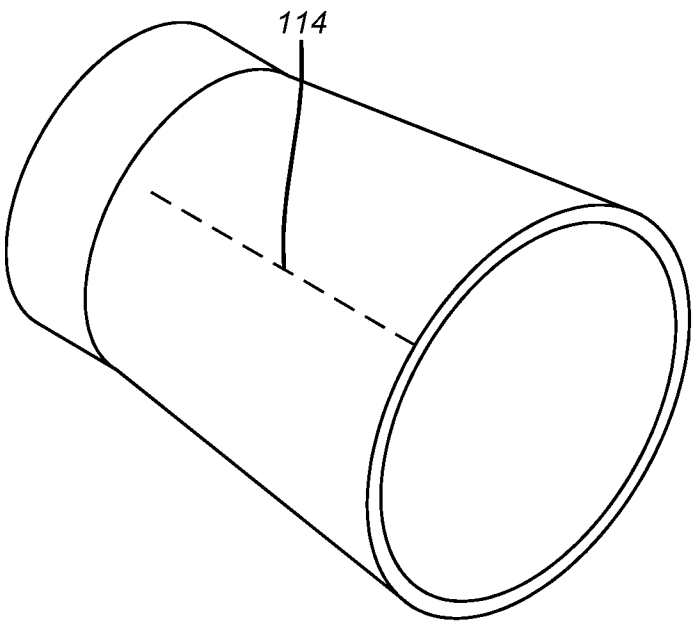
FIG. 9 is the view of FIG. 8 in the set position.
Figure 8:
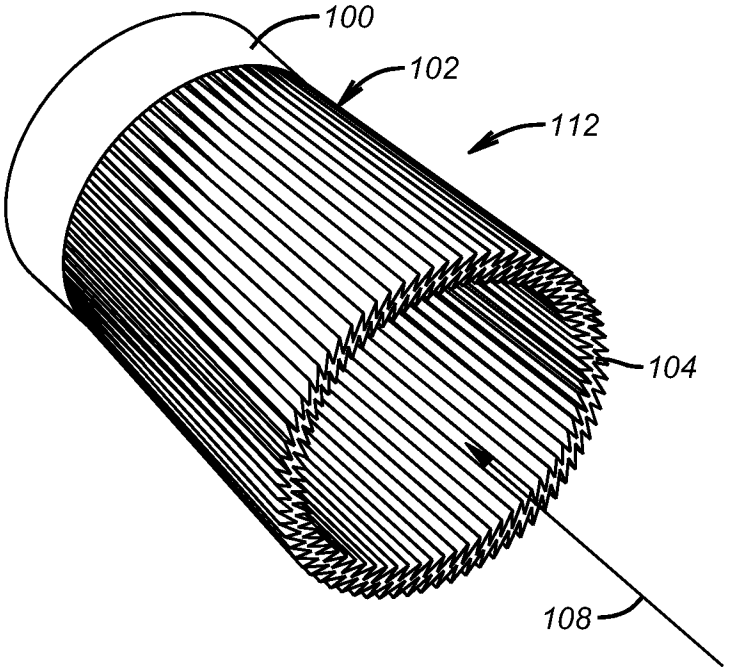
FIG. 8 is the pleated version of the cup seal of the present invention in the run in position with the retaining band omitted.

FIGS. 1-7 illustrate a method in general terms in which the seal of the present invention can be 28 or 30 and will be used as an introduction before discussing the specifics of the seal in greater detail. FIGS.8 and 9 show these seals in detail as having an annular base 100 and a body 102 that extends from the base. An existing tubular 10 has a bottom bell 12. As an option there can be an open hole where at least portions thereof have no existing tubular 10. A running string 14 has a lower end 16 that initially and releasably supports the tubular string or liner 18. A swage assembly 20 has three segmented swage rings 22, 24 and 26. While three adjustable swages are preferred, the various expansions can be done with at least one swage that is adjustable to differing expansions diameters to perform the various method steps at the time those method steps need to occur and providing the targeted degree of expansion at each step. A swage assembly seal 28 is mounted to the running string 14 for tandem movement and extends radially for initial sealing contact with the bell 12. The liner 18 has a top seal 30 that is allowed to engage the bell 12 when the expansion starts to engage the slips 32 to the bell 12. A seal 34 is set against the bell 12 by expansion after cementing takes place. The lower end 16 acts as a travel stop for the swage assembly 20. The swage assembly 20 and the seal 28 can move relatively to the running string 14. The running string 14 is preferably anchored to the existing tubular 10 when pressure against seal 28 drives the swage assembly 20 relative to the running string 14 until the travel stop at the lower end 16 is reached.

Figure 1:
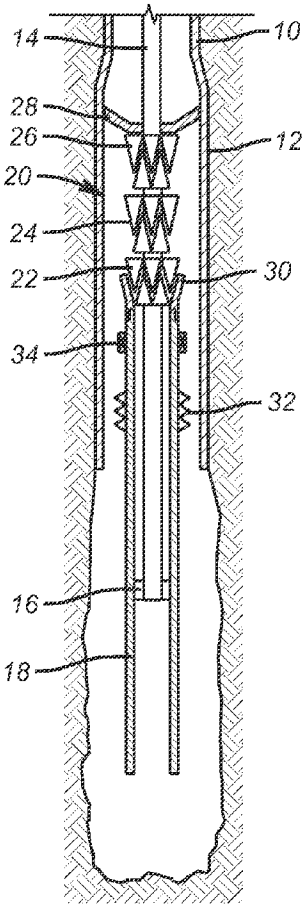
FIG. 1 shows the liner supported by the running string in the desired location at the lower end of the existing tubular.
Figure 2:
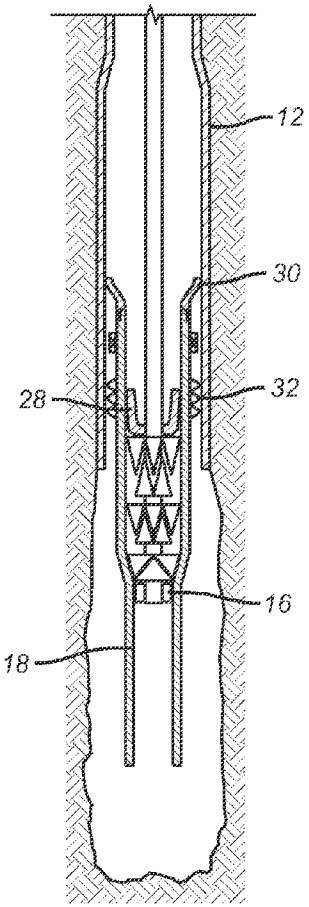
FIG. 2 is the view of FIG. 1 showing the advancing swage assembly supporting the liner to the surrounding tubular.

FIG. 2 shows annulus pressure around the running string 14 and against the seal 28 driving the swage assembly 20 along the running string 14 that is now anchored to the existing tubular 10. Note that the seal 30 at the top of the liner 18 is against the bell 12 so that the seal 28 can still be driven into the liner 18 to the point where the travel stop at the lower end 16 is engaged and the slips 32 being set to support the liner 18 to the bell 12.

Figure 3:
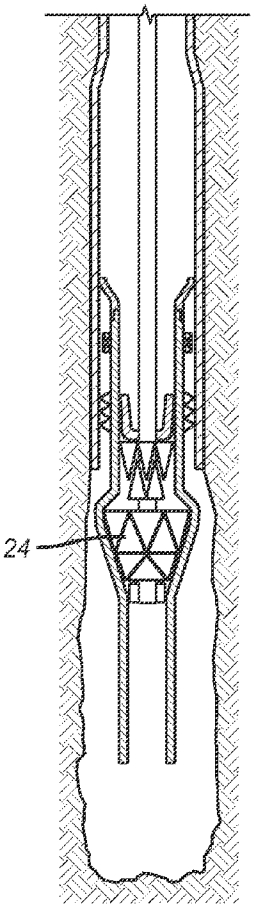
FIG. 3 is the view of FIG. 2 showing the swage assembly having passed the lower end of the existing tubular and being built to finish the expansion.
Figure 4:
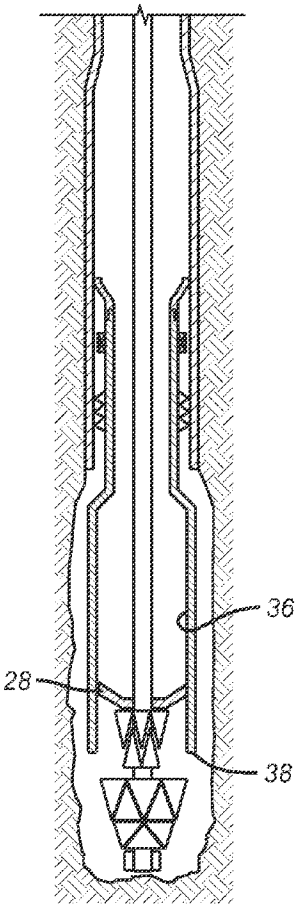
FIG. 4 is the view of FIG. 3 showing the swage assembly out the lower end of the expanded tubular and ready to locate and set a cementing shoe at the lower end to facilitate the cementing step.

In FIG. 3, the swage 24 is built in place and the pressure against seal 28 continues so that the swage assembly 20 is driven out the lower end of the liner 18 as shown in FIG. 4. A bell 36 is now created in the lower end of the liner 18. While the expansion reached the lower end 38, a cement shoe that is not shown was grabbed and put out beyond the end 38 and then brought back after the swage assembly 20 was pushed past the lower end 38. When the cement shoe is brought back into the bell 36 it is secured and sealed to the bell 36 and the connection is pressure tested before the cement delivery begins as shown in FIG. 5.

Figure 5:
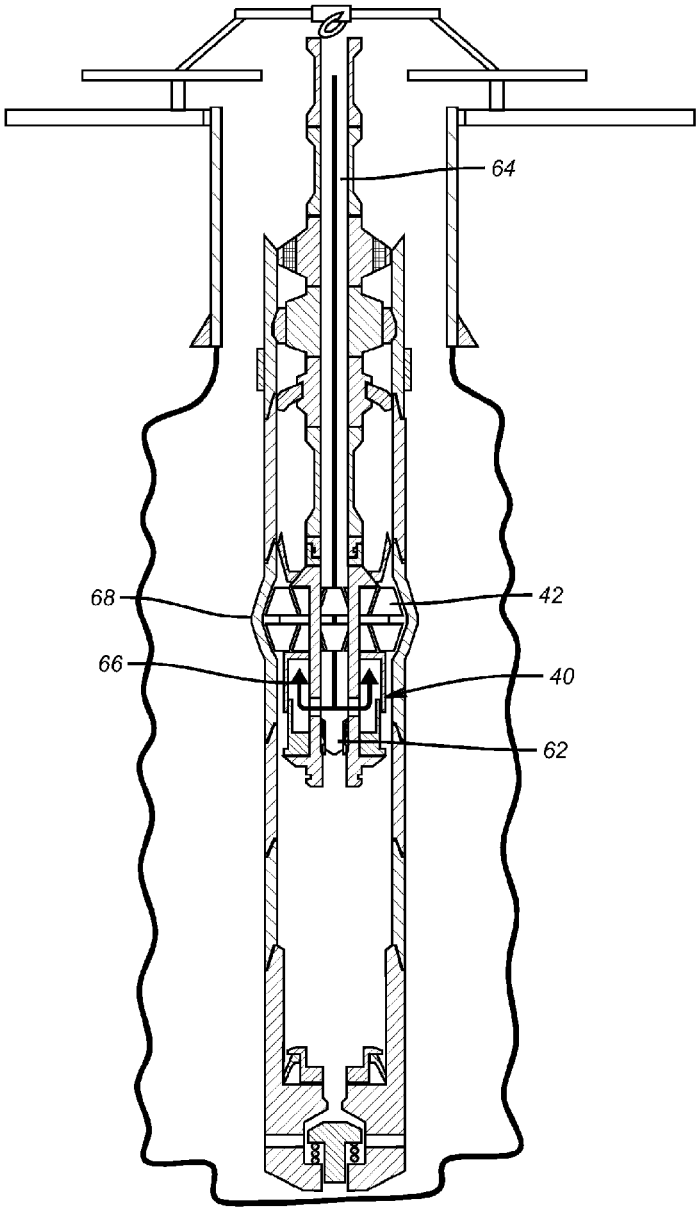
FIG. 5 is the view of FIG. 4 after cementing is done and the swage assembly is raised out of the liner and built again to set the liner hanger seal.
Figure 6:
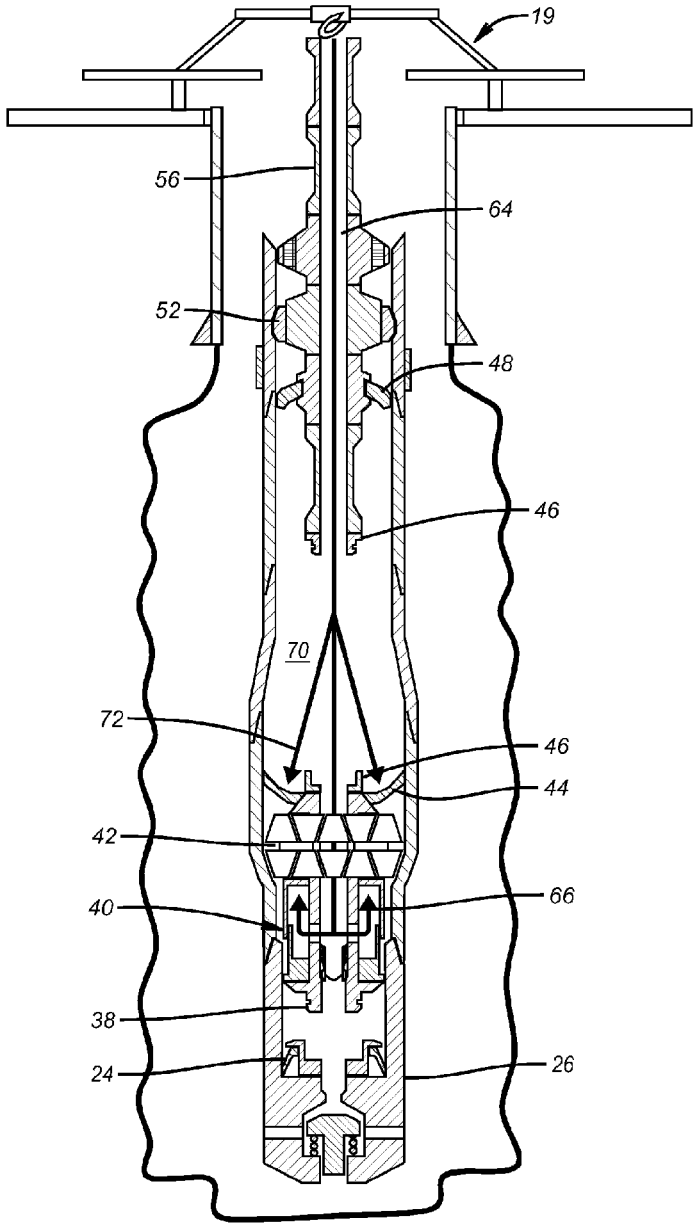
FIG. 6 shows the swage assembly brought down from the FIG. 5 position to set the liner hanger seal.
Figure 7:
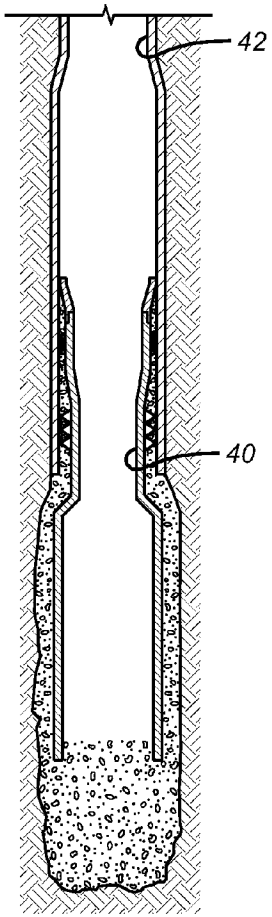
FIG. 7 is the view of FIG. 6 with the running string removed.

FIG. 5 shows the cement 38 delivered and the running string 14 picked up to put the swage assembly 20 above the seal 30 so that swage 26 can be built for subsequent setting of the seal 34 against the bell 12 as shown in FIG. 6. After setting the seal 34 against the bell 12 the running string 14 and everything that it supports is removed leaving a cemented monobore connection where the diameter at 40 is the same as the diameter at 42 and a bell 36 is formed the same as the diameter at 12. Optionally in FIG. 6 the swage 26 can be pushed with pressure past the slips 32 to insure the same dimension 40 at both the slips 32 and the adjacent hanger seal 34.

Figure 11:
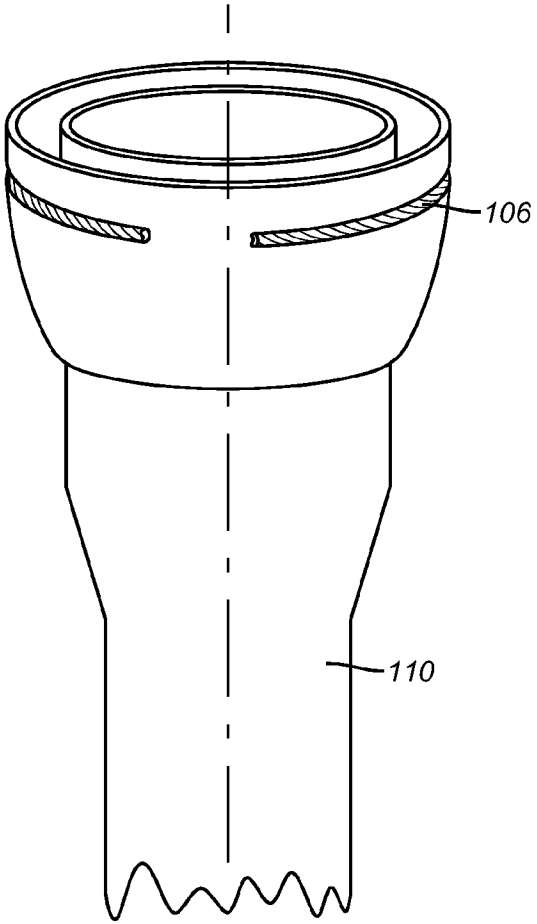
FIG. 11 shows the seal of FIG. 10 with the band broken due to tubular expansion.
Figure 10:
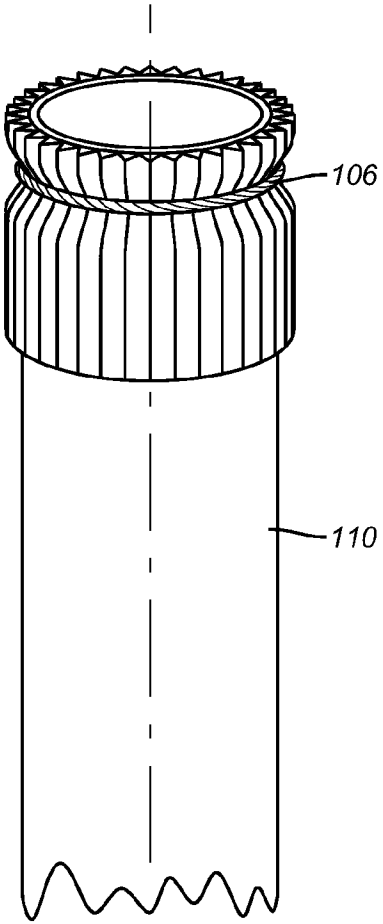
FIG. 10 is an alternative view of the pleated version of the cup seal showing the retaining band in place.

The seal of the present invention is shown in a first embodiment in FIGS. 8-10. In this design there is a base ring 100 from which the body 102 extends. There are pleats 104 that fold over each other so that the overall shape for run in is closer to a cylindrical shape than a cone. Omitted in this view for clarity is the band 106 that is shown in FIGS. 10 and 11. Pressure represented by arrow 108 can be delivered from above to break the band 106 and unfold the pleats 104. As shown in FIG. 9, in the extreme position of unfolding the pleats 104 can be fully extended so as to present an almost smooth or totally smooth surface shown in FIG. 9. Depending on where the seal is mounted the base 100 can be expanded with the tubular 110 to which it is attached as graphically illustrated in FIGS. 9 and 10. The material for the seal can be a resilient material that is bonded to the tubular 110 or sealingly attached to it in other ways such as with adhesive. The material should be compatible with well fluids and operating temperatures and can be rubber. Alternatively the material can also interact with well fluids or added fluids and swell in a manner that unfolds the pleats and enhances the seal against the surrounding tubular that is not shown. Alternatively only a portion of the assembly can swell such as the ring 100. A taper angle of the seal in FIGS. 8-10 of between 3 and 20 degrees is preferred. The seal can be used in isolation or in stacked multiples that are adjacent or spaced apart from each other. The seals in a backup location may not initially deploy until a seal above them fails to deploy or hold pressure for any reason.

One of the advantages of the cup shape design of the seal 112 is that it stops flow in one direction and permits flow in the opposite direction. The seal can also travel with the tubular or other structure to which it is attached so that pressure can be used in conjunction with the seal 112 to drive the string or tool to which the ring 100 is attached. As shown in FIGS. 1-7 the driven tool is a multi-position swage assembly 22, 24 and 26. On the other hand the seal such as 30 when made as shown in FIGS. 8-10 can also allow displaced annulus fluids to get past seal 112 as the cement advances through a cement shoe and pushes well fluid up the annulus. It is also possible for cement to get past the seal 112 by moving in a direction to the surface of the well.

Accordingly the advantages of the seal 112 are that is can be mounted to a tubular that is actually expanded and the expansion aids the seal. The seal can optionally be effective during run in when the body 102 of the seal 112 engages the surrounding tubular during run in. In that case pressure from above helps set the seal or heighten its already effective sealing position. Expansion of the ring 100 with tubular 110 expansion can also aid the body 102 to seal or/and can move the ring 100 into sealing position, if no further axial movement of the ring 100 is contemplated after expansion. Alternatively with band 106 the expansion of the tubular can break the band 106 and allow the tendency of the body 102 to expand to initiate the radial movement toward the surrounding tubular aided by pressure from above represented by arrow 108. Alternatively, the pleats 104 can have internal, external or embedded stiffeners, one of which 114 is illustrated in FIG. 9 to aid the radial movement to the surrounding tubular when the band 106, if used, breaks from expansion of tubular 110.

Figure 13:
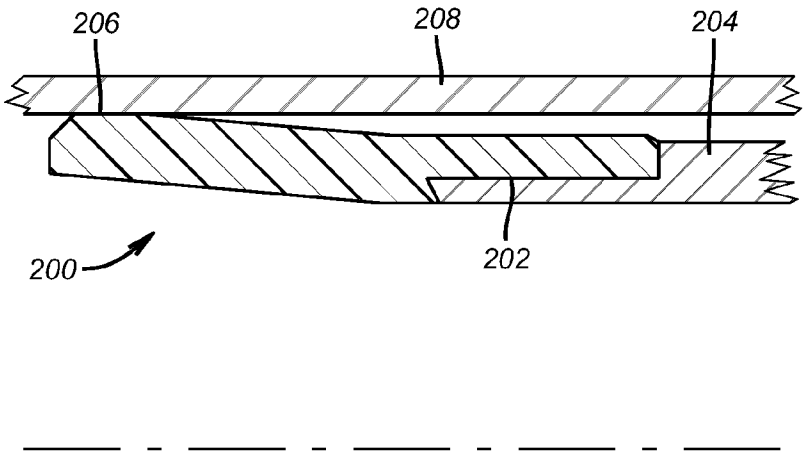
FIG. 13 is the view of FIG. 12 in the expanded position of the tubular.
Figure 12:
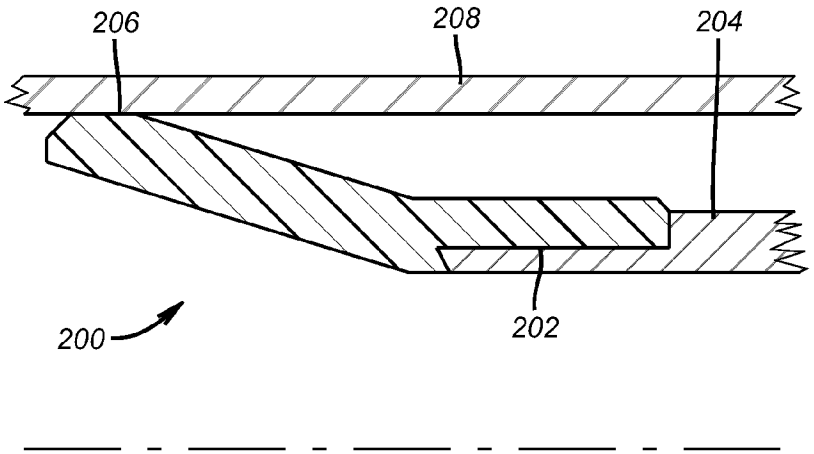
FIG. 12 shows an annular cup seal on a tubular that will be expanded in the run in position.

An alternative design is shown in FIGS. 12 and 13. It is a cup shaped seal 200 that is mounted to a notch 202 shown at the top of a tubular 204. The mounting can be at other locations along the tubular or to a tool. As with the pleated version the same operational variations are envisioned. In this embodiment the end 206 rides on the surrounding tubular 208 for an initial seal on entry before the tubular 204 is expanded as shown in FIG. 13. As a result a retaining band is not needed in this embodiment. Expansion further secures the seal and the advantages stated above for the pleated design can also be attained by the seal 200 that is a cup shape mounted to a tubular that is expanded that seals in one direction and allows flow to bypass in the opposed direction.

When used in this application "cup seal" refers to an annular member that is circumferentially unitary and spans an annular gap to a tubular or wellbore wall and allows flow past itself in one direction while retaining pressure in an opposite direction.

The above description is illustrative of the preferred embodiment and many modifications may be made by those skilled in the art without departing from the invention whose scope is to be determined from the literal and equivalent scope of the claims below:

The invention claimed is:

1. A method of sealing around a supporting tubular in a subterranean location to a surrounding tubular or a wellbore wall, comprising:

mounting at least one expandable cup seal assembly to the supporting tubular;

providing, at a first end on said cup seal assembly, an annular base secured to the supporting tubular and a tapered component extending from said annular base to a second end of said cup seal assembly that is selectively in contact with the surrounding tubular;

increasing in tandem the size of the supporting tubular, at a location of said annular base, and said annular base.

2. The method of claim 1, comprising:

retaining the expandable cup seal assembly in a retracted position for run in;

releasing said expandable cup seal assembly to move radially with said increasing the size of the supporting tubular.

3. The method of claim 2, comprising:

breaking a band around said expandable cup seal assembly with said increasing the size of the supporting tubular.

4. The method of claim 1, comprising:

providing overlapping pleats on said cup seal assembly for run in.

5. The method of claim 4, comprising:

opening said pleats after run in.

6. The method of claim 5, comprising:

using pressure against said pleats to open said pleats.

7. The method of claim 1, comprising:

allowing said expandable cup seal assembly to engage a surrounding tubular or the wellbore when running in.

8. The method of claim 7, comprising:

mounting an additional cup seal assembly adjacent a swage, whereupon advancement of said swage expands said supporting tubular.

9. The method of claim 8, comprising:

providing at least one stiffener associated with said expandable cup seal assembly.

10. The method of claim 9, comprising:

providing a bias into said annular space for said expandable cup seal assembly with said stiffener.

11. The method of claim 8, comprising:

using said expandable cup seal assembly to seal externally of said surrounding tubular to be expanded by said swage with said additional cup seal assembly sealing internally to said tubular to be expanded to allow pressure against said expandable and additional cup seal assemblies to drive said swage.

12. The method of claim 1, comprising:

providing at least a portion of the expandable cup seal assembly of a material that swells in the presence of well fluids.

13. The method of claim 1, comprising:

shaping an extending portion of said expandable cup seal assembly as a truncated cone.

14. The method of claim 13, comprising:

providing pleats in said truncated cone shape.

15. The method of claim 14, comprising:

unfolding said pleats with pressure applied into said truncated cone shape;

moving fluid past an exterior of said truncated cone shape when cementing.

16. The method of claim 14, comprising:

retaining said pleats in a retracted position for run in;

releasing said pleats to span said annulus by enlarging said supporting tubular.

17. The method of claim 16, comprising:

breaking a band retaining said pleats with enlarging said supporting tubular.

18. The method of claim 14, comprising:

providing stiffeners associated with said pleats.

19. The method of claim 14, comprising:

making said annular base of a material that swells on exposure to fluid at the subterranean location.

20. The method of claim 14, comprising:

providing a plurality of stacked expandable cup seals assemblies on said supporting tubular;

securing said expandable cup seal assemblies to a groove on said supporting tubular.

* * * * *